US007645188B1

(12) United States Patent
Peerbolt

(10) Patent No.: US 7,645,188 B1
(45) Date of Patent: Jan. 12, 2010

(54) AIR DIFFUSER APPARATUS

(76) Inventor: Morris Peerbolt, 845 Claremont Ct., Holland, MI (US) 49423

( * ) Notice: Subject to any disclaimer, the term of this patent is extended or adjusted under 35 U.S.C. 154(b) by 0 days.

(21) Appl. No.: 11/901,416

(22) Filed: Sep. 17, 2007

(51) Int. Cl.
*F24F 13/06* (2006.01)
*F24F 13/08* (2006.01)

(52) U.S. Cl. ..... 454/296; 454/284; 454/292; D23/388

(58) Field of Classification Search ..... 454/284, 454/292, 294, 296, 297, 298, 300, 310, 311; D23/388
See application file for complete search history.

(56) References Cited

U.S. PATENT DOCUMENTS

| | | | | | |
|---|---|---|---|---|---|
| 1,926,795 | A | * | 9/1933 | Sassenberg | 454/286 |
| 1,973,490 | A | * | 9/1934 | Kurth et al. | 454/261 |
| 2,251,682 | A | * | 8/1941 | Leadbetter | 454/108 |
| 2,255,849 | A | * | 9/1941 | Kurth | 362/294 |
| 2,618,215 | A | * | 11/1952 | Fitt | 454/310 |
| 3,084,609 | A | * | 4/1963 | Onstad | 454/296 |
| 3,099,200 | A | * | 7/1963 | Harrison | 454/297 |
| 3,403,614 | A | | 10/1968 | Carnes | |
| 3,559,560 | A | | 2/1971 | Trahan | |
| 4,020,752 | A | | 5/1977 | Stephan | |
| 4,335,647 | A | * | 6/1982 | Timmons | 454/300 |
| 4,890,544 | A | * | 1/1990 | Aalto et al. | 454/49 |
| D325,434 | S | | 4/1992 | Dosmann | |
| 5,167,577 | A | * | 12/1992 | Kristensson | 454/298 |
| 5,807,171 | A | | 9/1998 | Felsen | |
| 6,077,160 | A | * | 6/2000 | Franaszek et al. | 454/292 |
| 6,135,878 | A | | 10/2000 | Felsen | |
| 6,264,551 | B1 | * | 7/2001 | Smith | 454/248 |
| 6,702,662 | B2 | * | 3/2004 | Kristensson | 454/187 |
| 6,935,571 | B2 | | 8/2005 | Van Der Merwe | |
| 7,022,010 | B1 | * | 4/2006 | Cardon | 454/292 |
| D521,631 | S | | 5/2006 | Habensus | |

OTHER PUBLICATIONS

Hart & Cooley T-Bar Diffusers, Copyright 1983.
Hart & Cooley T-Bar Installation Ceiling Diffusers, Copyright 1983.

* cited by examiner

*Primary Examiner*—Steven B McAllister
*Assistant Examiner*—Patrick F. O'Reilly, III
(74) *Attorney, Agent, or Firm*—King & Partners, PLC

(57) ABSTRACT

An air diffuser for distributing air into a room from a supply duct of an air distribution system having: a frame member, wherein the frame member includes an inner surface, and an outer surface; an attachment member, wherein the attachment member is associated with the frame member, and further wherein the attachment member is configured for associating the air diffuser with a supply duct; and a diffusing member, wherein the diffusing member comprises a substantially hemispherical dome having an inner surface, an outer surface, and a plurality of apertures, and wherein the substantially hemispherical dome emanates away from the outer surface of the frame member.

18 Claims, 5 Drawing Sheets

AIR DIFFUSER APPARATUS

CROSS-REFERENCE TO RELATED APPLICATION(S)

Not Applicable

BACKGROUND OF THE INVENTION

1. Field of the Invention

The present invention relates in general to air diffusers and, more particularly, to air diffusers which are adapted for mounting in a wall or ceiling of a room for distributing air into the room from an air distribution system, such as a heating, ventilation, and air-conditioning (HVAC) system.

2. Background Art

Air diffusers have been known in the art for years, and are the subject of numerous patents, including: U.S. Pat. No. D325,434 entitled "Air Diffuser," U.S. Pat. No. D521,631 entitled "Air Diffuser," U.S. Pat. No. 3,403,614 entitled "Environmental Enclosure With Ceiling Air Plenum," U.S. Pat. No. 3,559,560 entitled "Ceiling Boxes For Distributing Air," U.S. Pat. No. 4,020,752 entitled "Air Diffuser With Modular Core," U.S. Pat. No. 5,807,171 entitled "Air Diffuser Apparatus," U.S. Pat. No. 6,135,878 entitled "Modular Core Air Diffusers," and U.S. Pat. No. 6,935,571 entitled "Air Diffuser"—all of which are hereby incorporated herein by reference in their entirety including the references cited therein.

U.S. Pat. No. 3,403,614 appears to disclose an environmentally controlled enclosure having a plenum chamber into which conditioned air is introduced for distribution into the enclosure. The lower plenum boundary, which is the enclosure ceiling, is perforated to provide air flow into the enclosure. Enclosure illumination is provided through light units within the plenum chamber and provision is made for distributing heat generated by the light units.

U.S. Pat. No. 3,559,560 appears to disclose ceiling boxes used to distribute air down through the ceiling of a room from a furnace or cooler. The ceiling box appears to be of rectangular form and is constructed so that it may be installed between the ceiling joists—in a position with its length extending either parallel with or transversely of the joists, as desired. To achieve this the ceiling box is adapted to be supported on one joist only, and is secured to this joist by means of fastening devices passing through either an end wall or a sidewall of the ceiling box. The open lower side of the ceiling box is covered by a suitable grille through which the air is discharged.

U.S. Pat. No. 4,020,752 appears to disclose an air diffuser with a modular core in which the diffuser comprises a fixed rectangular framework retaining a plurality of removable rectangular core elements. The direction and volume of air distributed by the diffuser is selectively changed by adjusting the position of the circulation blades comprising the modular core elements and by altering the orientation of the elements. Each element is retained on two sides by the fixed framework and is secured to the framework by a spring clip located at a corner of the element.

U.S. Pat. No. 5,807,171 appears to disclose an air diffuser apparatus having a box-like air diffuser chamber with sheet metal side walls that are provided with a series of laterally spaced outlet orifices. Each orifice is formed by cutting out wing portions of the sheet metal on each side of a center line of the orifice and bending the wing portions outwardly to a position inclining toward this center line. The wing portions define an air flow passage tapering in an outward direction.

U.S. Pat. No. 6,135,878 appears to disclose modular ceiling air diffusers in which the core deflector elements are pre-fabricated in a one-hit one-part pressing operation to form a selected pattern of integral louvers shaped to deflect air in a desired horizontal air pattern.

U.S. Pat. No. 6,935,571 appears to disclose a diffuser comprising a casing, a first temperature sensitive element for sensing room temperature variations and including a body and a piston which move relative to one another in response to temperature variations, a second temperature sensitive element, an airflow control structure including a damper blade having a first position in which airflow is restricted and a second position in which a greater air flow is permitted, and an actuator for displacing the blade between the first and second positions in response to room temperature variations.

U.S. Pat. No. D325,434 and U.S. Pat. No. D521,631 appear to disclose a plurality of ornamental configurations for air diffuser apparatuses.

While the above-identified patents do appear to provide air diffuser apparatuses, their configurations remain non-desirous and/or problematic inasmuch as, among other things, none of the above-identified apparatuses appear to be configured to effectively reduce and/or eliminate temperature non-uniformity, such as, for example, hot spots, cold spots, drafts, etcetera—among other things.

It will be understood that the term "diffuser" is used to designate those devices which, in air distribution systems, are employed for the purpose of regulating flow of air, which may be heated air or cooled air, from ducting into a room.

It is therefore an object of the present invention to provide an air diffuser apparatus which, among other things, remedies the aforementioned detriments and/or complications associated with the use of the above-identified, conventional air diffuser apparatuses.

These and other objects of the present invention will become apparent in light of the present specification, claims, and drawings.

SUMMARY OF THE INVENTION

In one embodiment, the present invention is directed to an air diffuser for distributing air into a room from a supply duct of an air distribution system, comprising: (a) a frame member, wherein the frame member comprises an inner surface, and an outer surface; (b) an attachment member, wherein the attachment member is associated with the frame member, and further wherein the attachment member is configured for associating the air diffuser with a supply duct; and (c) a diffusing member, wherein the diffusing member comprises a substantially hemispherical dome having an inner surface, an outer surface, and a plurality of apertures, and wherein the substantially hemispherical dome emanates away from the outer surface of the frame member.

In a preferred embodiment of the present invention, at least a majority of the plurality of apertures comprise a circular geometry.

In another preferred embodiment of the present invention, the plurality of apertures consist of a circular geometry.

In yet another preferred embodiment of the present invention, at least approximately 40% of the total surface area of the substantially hemispherical dome comprises the plurality of apertures, more preferably at least approximately 50% of the total surface area of the substantially hemispherical dome comprises the plurality of apertures, and yet more preferably at least approximately 60% of the total surface area of the substantially hemispherical dome comprises the plurality of apertures, and most preferably at least approximately 70% of the total surface area of the substantially hemispherical dome comprises the plurality of apertures.

In still another preferred embodiment of the present invention, the substantially hemispherical dome comprises a plurality of evenly distributed apertures.

In another aspect of the present invention, the frame member preferably further comprises an aperture for containing the diffusing member.

In one embodiment of the present invention, the diffusing member further comprises an outer rim, and wherein the outer surface of the diffusing member contacts the inner surface of the frame member along at least a portion of the outer rim, and the inner surface of the diffusing member is preferably at least partially covered with a support member along at least a portion of the outer rim.

In a preferred embodiment of the present invention, the support member, the diffuser member, and the frame member are fixedly attached together.

In another preferred embodiment of the present invention, the frame member and the diffuser member comprise a unitary member.

In yet another preferred embodiment of the present invention, at least two of the frame member, the diffuser member, the support member, and the attachment member comprise a unitary member and/or are secured together to form a single component.

In still another preferred embodiment of the present invention, the air diffuser facilitates substantially even distribution of air throughout an associated room, substantially reduces drafts during operation of an associated air distribution system, and/or substantially reduces a temperature gradient in an associated room.

In accordance with the present invention, the diffuser member further preferably comprises at least one of a light, a microphone, a camera, an air freshener, and combinations thereof.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein.

DETAILED DESCRIPTION OF THE INVENTION

Figure 1:
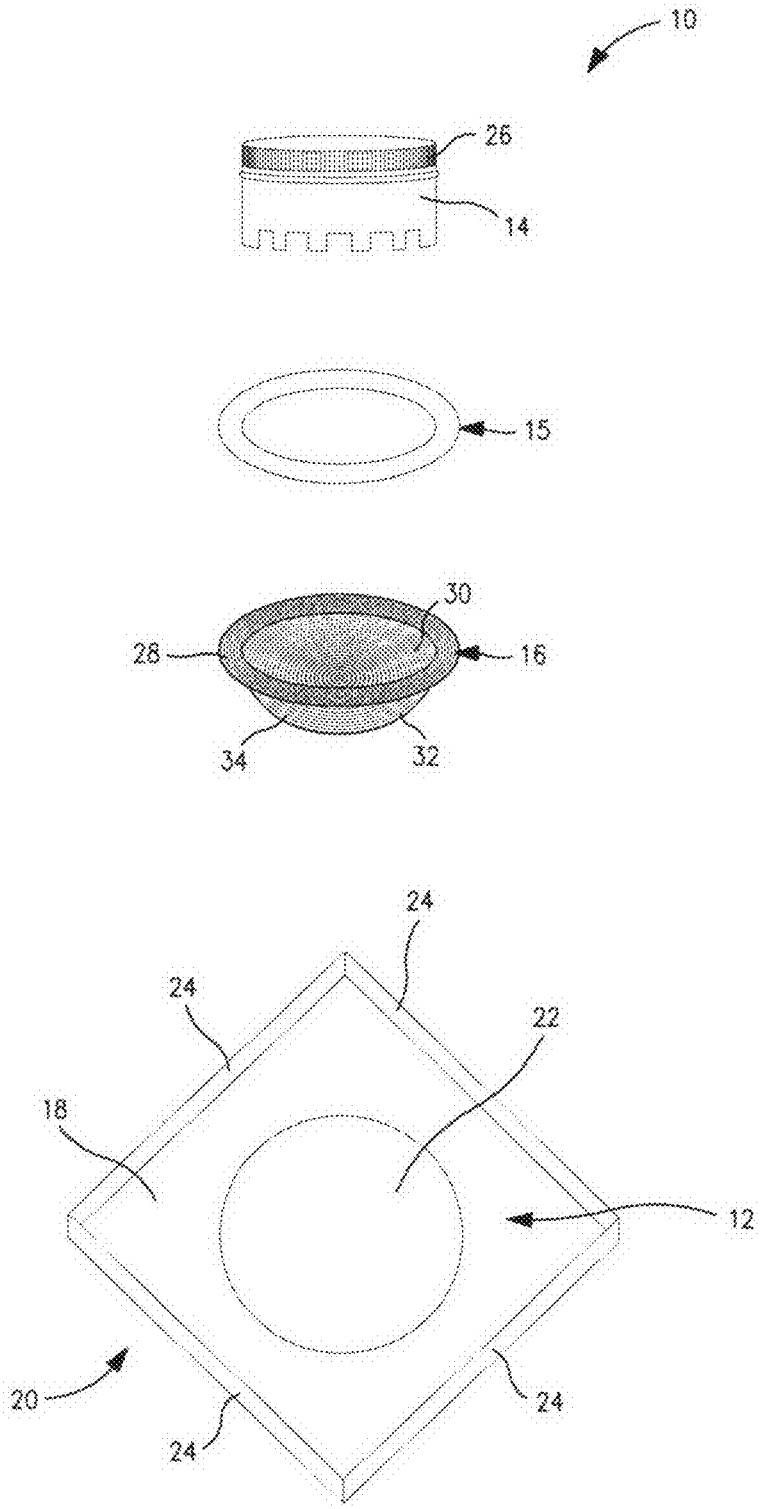
FIG. 1 of the drawings is an exploded, perspective view of an air diffuser apparatus fabricated in accordance with the present invention.
Figure 2:
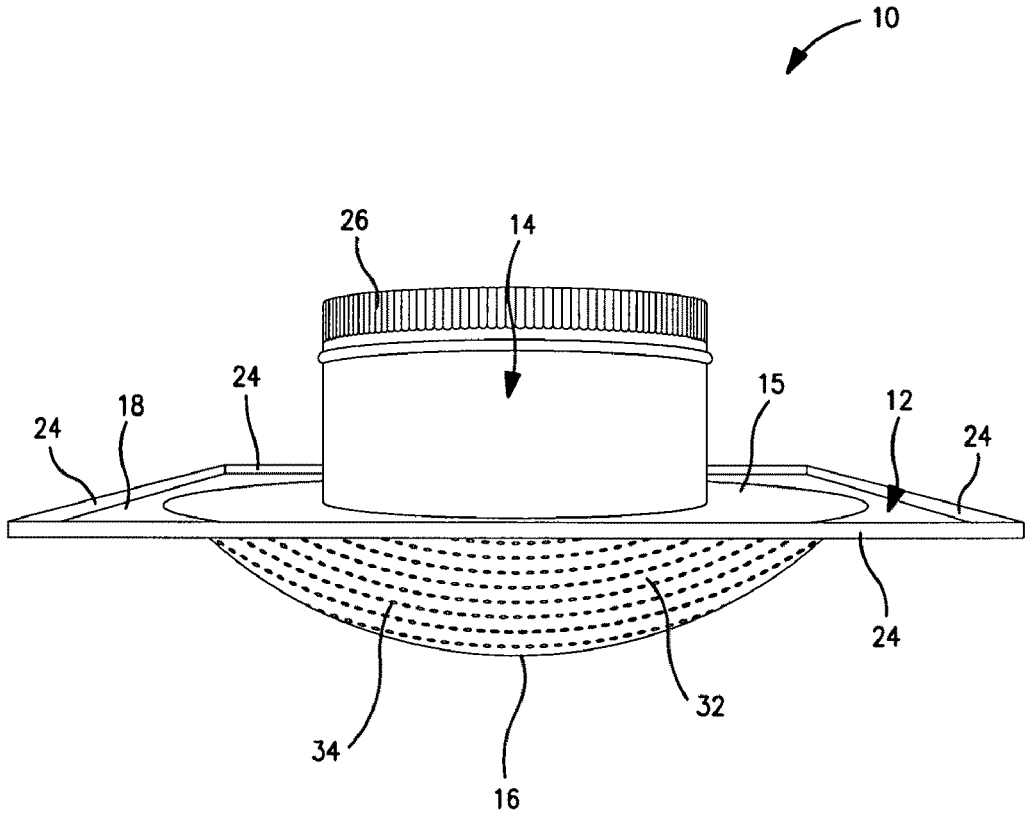
FIG. 2 of the drawings is an elevated side view of an air diffuser apparatus fabricated in accordance with the present invention.
Figure 3:
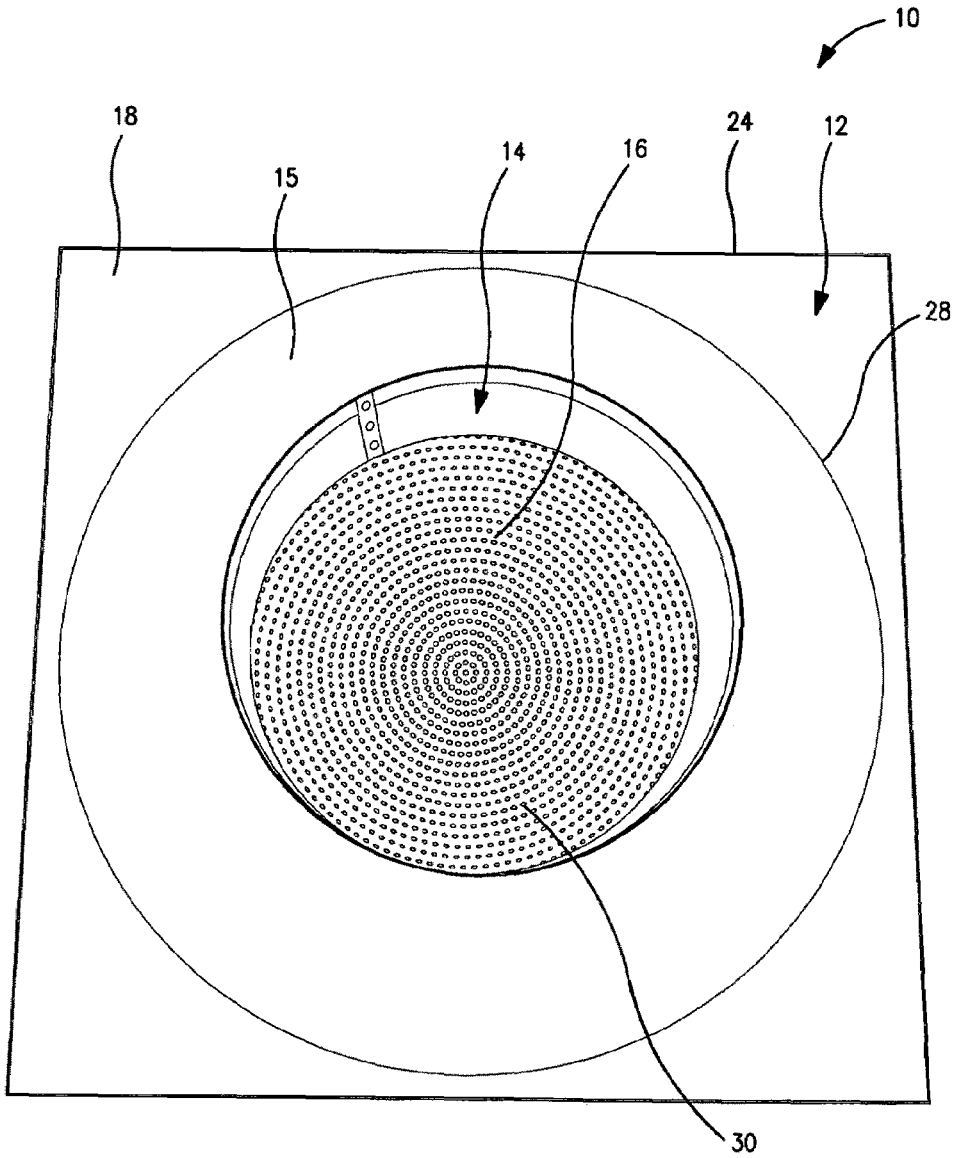
FIG. 3 of the drawings is a top plan view of an air diffuser apparatus fabricated in accordance with the present invention.
Figure 4:
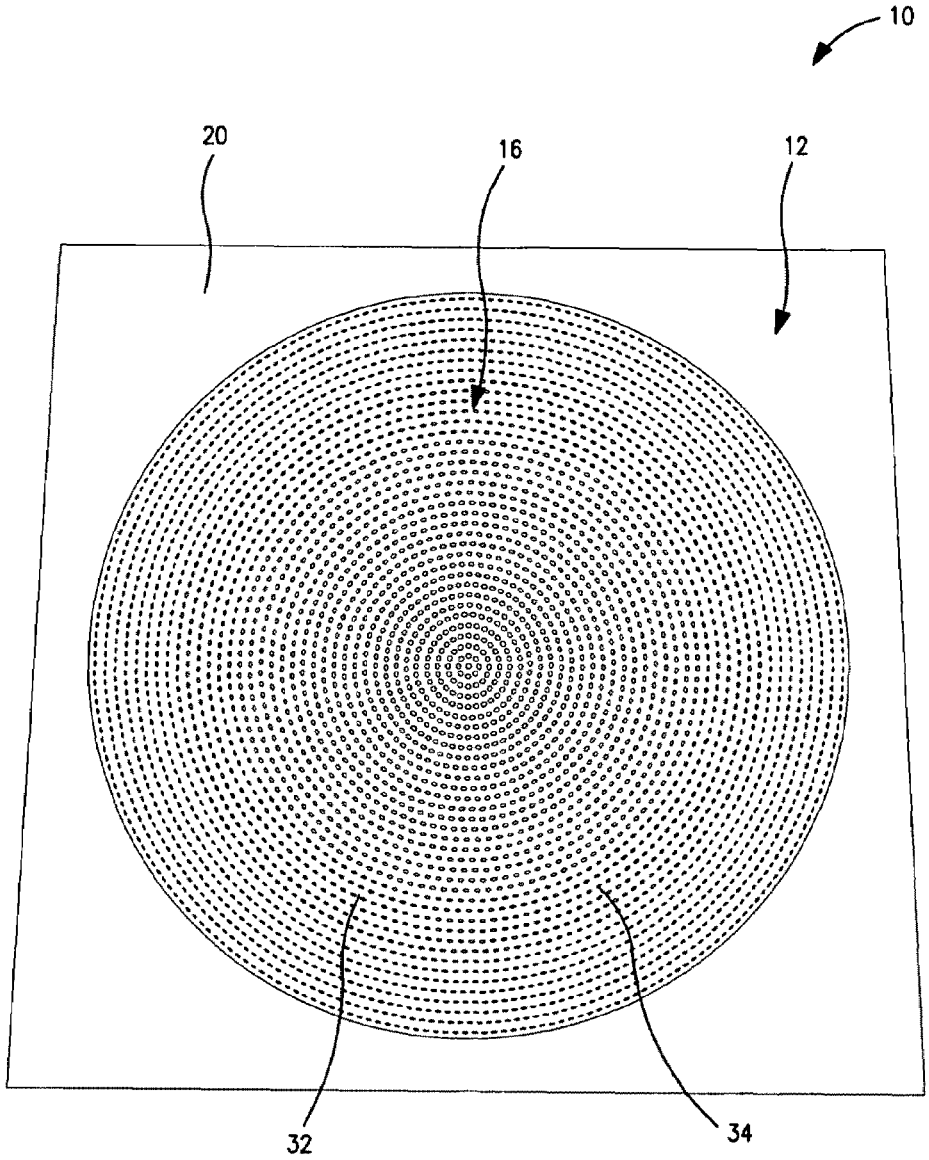
FIG. 4 of the drawings is a bottom plan view of an air diffuser apparatus fabricated in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the collective drawings (i.e. FIGS. 1-4), and to FIG. 1 in particular, an exploded perspective view of a first embodiment of air diffuser apparatus 10 is shown which generally comprises frame member 12, attachment member 14, and diffusing member 16. It will be understood that air diffuser apparatus 10 may be fabricated from a unitary member or a plurality of pieces. It will be further understood that FIG. 1 is merely a representation of air diffuser apparatus 10. As such, some of the components may be distorted from their actual scale for pictorial clarity.

Figure 5:
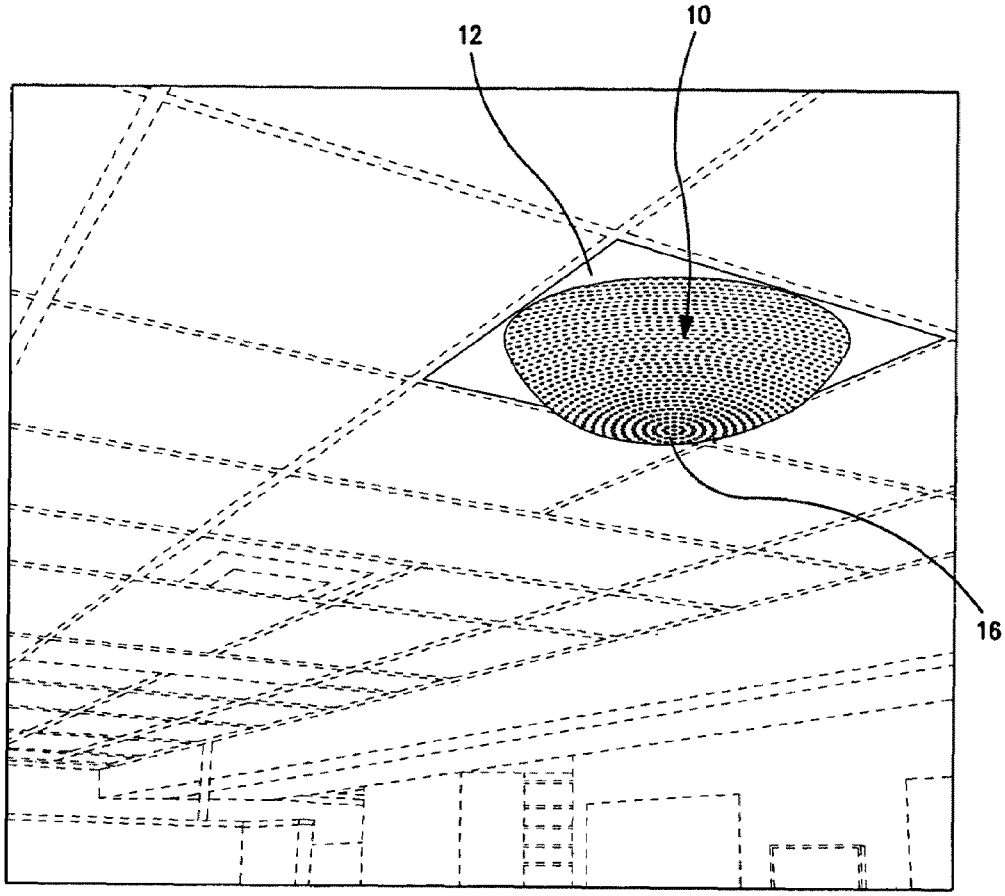
FIG. 5 of the drawings is a perspective view of an air diffuser apparatus fabricated in accordance with the present invention.

Frame member 12 includes, among other components, inner surface 18 and outer surface 20, wherein inner surface 18 is generally opposite outer surface 20. Frame member 12 also preferably includes aperture 22 for containing and/or retaining diffusing member 16. However it will be understood that if frame member 12 and diffusing member 16 are fabricated as a unitary member, then such an aperture may not be necessary. While aperture 22 has been shown as being generally circular, any one of a number of other geometric configurations are likewise contemplated for use in accordance with the present invention. In a preferred embodiment frame member 12 further includes a plurality of generally vertical walls 24. It will be understood that frame member 12 is configured to generally conform to adjacent ceiling tiles and/or panels—among other things as is shown in FIG. 5. Frame member 12 is preferably fabricated from, for example, metals (e.g. aluminum, tin, copper, nickel, titanium, steel, and alloys thereof), natural resins, synthetic resins, plastics, composites, woods, and mixtures thereof.

Attachment member 14 is associated with frame member 12 and is configured for associating (e.g. attaching, affixing, etcetera) air diffuser 10 with a supply duct of an air distribution system, such as, for example, a heating, ventilation, and air-conditioning (HVAC) system. Attachment member 14 includes flutes 26 for assisting with securement to a supply duct. Like frame member 12, attachment member 14 is preferably fabricated from, for example, metals (e.g. aluminum, tin, copper, nickel, titanium, steel, and alloys thereof), natural resins, synthetic resins, plastics, composites, woods, and mixtures thereof. It will be understood that attachment member 14 may comprise any one of a number of different diameters to accommodate a variety of flow rates.

Support member 15 is associated with attachment member 14 and may collectively form a collar ring. Support member 15 at least partially covers optional rim 28 of diffusing member 16. It will be understood that support member 15 is preferably fabricated from, for example, metals (e.g. aluminum, tin, copper, nickel, titanium, steel, and alloys thereof), natural resins, synthetic resins, plastics, composites, woods, and mixtures thereof.

Diffusing member 16 comprises a substantially hemispherical dome having an inner surface 30, outer surface 32, a plurality of apertures 34, and optionally rim 28. The hemispherical dome of diffusing member 16 emanates away from outer surface 20 of frame member 12. It will be understood that, regardless of its ordinary meaning, the term "substantially hemispherical dome" encompasses domes wherein the height and radius of the dome are not necessarily equal. Preferably at least a majority of apertures 34 of diffusing member 16 comprises a circular geometry. In accordance with the present invention, at least approximately 40% of the total surface area of the substantially hemispherical dome of diffusing member 16 comprise the plurality of apertures, preferably at least approximately 50%, more preferably at least approximately 60%, and yet more preferably at least approximately 70%. Apertures 34 of diffusing member 16 are preferably distributed evenly over the surface area of the substantially hemispherical dome.

In one embodiment of the present invention, diffusing member 16 further comprises outer rim 28, whereby outer surface 32 of diffusing member 16 contacts inner surface 18 of frame member 12 along at least a portion of the outer rim. In further accordance with the present invention, inner surface 30 of diffusing member 16 is at least partially covered with support member 15 along at least a portion of the outer rim.

Preferably frame member 12, attachment member 14, support member 15, and diffuser member 16 are fixedly attached together by, for example, stamps, screws, bolts, nails, pins, anchors, rivets, and/or adhesives or bonding agents—just to name a few.

It will be understood that air diffuser 10 may include frame member 12, attachment member 14, and diffuser member 16 which are a unitary member and/or comprises separate components.

In accordance with the present invention, the inside of diffuser member 16 may comprise a hidden light, microphone, camera, and/or air freshener.

In operation, air diffuser 10, when associated with a supply duct of an air distribution system and mounted to a wall or ceiling of a room facilitates, among other things, substantially even distribution of air throughout an associated room, reduces drafts during operation of an associated air distribution system, and/or substantially reduces a temperature gradient in an associated room.

Without being bound to any one particular theory, it is believed that the substantially hemispherical dome of the diffusing member coupled with the aperture configuration enables the above-identified benefits of the air diffuser of the present invention.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. An air diffuser for distributing air into a room from a supply duct of an air distribution system, comprising:

a frame member, wherein the frame member comprises an inner surface, and an outer surface;

an attachment member, wherein the attachment comprises an upper end and a lower end, and wherein the upper end of the attachment member is secured to the supply duct of the air distribution system, and wherein the lower end of the attachment member is secured to the frame member, and wherein the attachment member facilitates fluid communication from the supply duct of the air distribution system to the diffusing member;

a diffusing member, wherein the diffusing member comprises a substantially hemispherical dome having an inner surface, an outer surface, and a plurality of apertures, and wherein the substantially hemispherical dome emanates away from the outer surface of the frame member and further wherein the diffusing member comprises an outer rim; and an annular support member, wherein the annular support member at least partially covers the inner surface of the diffusing member along at least a portion of the outer rim.

2. The air diffuser according to claim 1, wherein at least a majority of the plurality of apertures comprise a circular geometry.

3. The air diffuser according to claim 1, wherein the plurality of apertures consist of a circular geometry.

4. The air diffuser according to claim 1, wherein at least 40% of the total surface area of the substantially hemispherical dome comprises the plurality of apertures.

5. The air diffuser according to claim 1, wherein at least 50% of the total surface area of the substantially hemispherical dome comprises the plurality of apertures.

6. The air diffuser according to claim 1, wherein at least 60% of the total surface area of the substantially hemispherical dome comprises the plurality of apertures.

7. The air diffuser according to claim 1, wherein at least 70% of the total surface area of the substantially hemispherical dome comprises the plurality of apertures.

8. The air diffuser according to claim 1, wherein the substantially hemispherical dome comprises a plurality of evenly distributed apertures.

9. The air diffuser according to claim 1, wherein the frame member further comprises an aperture for containing the diffusing member.

10. The air diffuser according to claim 9, wherein the diffusing member further comprises an outer rim, and wherein the outer surface of the diffusing member contacts the inner surface of the frame member along at least a portion of the outer rim.

11. The air diffuser according to claim 10, wherein the support member, the diffuser member, and the frame member are fixedly attached together.

12. The air diffuser according to claim 1, wherein the frame member and the diffuser member comprise a unitary member.

13. The air diffuser according to claim 1, wherein at least two of the frame member, the diffuser member, a support member, and the attachment member comprise a unitary member.

14. The air diffuser according to claim 1, wherein the air diffuser facilitates substantially even distribution of air throughout an associated room.

15. The air diffuser according to claim 1, wherein the air diffuser substantially reduces drafts during operation of an associated air distribution system.

16. The air diffuser according to claim 1, wherein the air diffuser substantially reduces a temperature gradient in an associated room.

17. An air diffuser for distributing air into a room from a supply duct of an air distribution system, comprising:

a frame member, wherein the frame member comprises an inner surface, an outer surface, and an aperture;

an attachment member, wherein the attachment member comprises an upper end and a lower end, and wherein the upper end of the attachment member is secured to the supply duct of the air distribution system, and wherein the lower end of the attachment member is secured to the frame member, and wherein the attachment member facilitates fluid communication from the supply duct of the air distribution system to the diffusing member; and a diffusing member, wherein the diffusing member comprises a substantially hemispherical dome having an inner surface, an outer surface, and a plurality of apertures, wherein at least a majority of the plurality of apertures comprise a circular geometry, and further wherein the substantially hemispherical dome emanates away from the outer surface of the frame member, and further wherein the diffusing member comprises an outer rim, and wherein the outer surface of the diffusing member contacts the inner surface of the frame member along at least a portion of the outer rim; and further wherein the inner surface of the diffusing member is at least partially covered with an annular support member along at least a portion of the outer rim; and further wherein at least 40% of the total surface area of the substantially hemispherical dome comprises the plurality of apertures.

18. An air diffuser for distributing air into a room from a supply duct of an air distribution system, comprising:

a frame member, wherein the frame member comprises an inner surface, an outer surface, and an aperture;

an attachment member, wherein the attachment member comprises an upper end and a lower end, and wherein the upper end of the attachment member is secured to the supply duct of the air distribution system, and wherein the lower end of the attachment member is secured to the frame member, and wherein the attachment member facilitates fluid communication from the supply duct of the air distribution system to the diffusing member; and a diffusing member, wherein the diffusing member comprises a substantially hemispherical dome having an inner surface, an outer surface, and a plurality of apertures, wherein the substantially hemispherical dome emanates away from the outer surface of the frame member, and further wherein the diffusing member comprises an outer rim, and wherein the outer surface of the diffusing member contacts the inner surface of the frame member along at least a portion of the outer rim; and further wherein the inner surface of the diffusing member is at least partially covered with an annular support member along at least a portion of the outer rim.

* * * * *